US008631743B2

(12) United States Patent
Pavec et al.

(10) Patent No.: US 8,631,743 B2
(45) Date of Patent: Jan. 21, 2014

(54) PRIMING DEVICE INITIATED ELECTRICALLY FOR A PROJECTILE

(75) Inventors: Pierre Pavec, Plou (FR); Renaud Lafont, Bourges (FR)

(73) Assignee: Nexter Munitions, Versailles (FR)

( * ) Notice: Subject to any disclaimer, the term of this patent is extended or adjusted under 35 U.S.C. 154(b) by 138 days.

(21) Appl. No.: 13/091,789

(22) Filed: Apr. 21, 2011

(65) Prior Publication Data

US 2011/0259226 A1 Oct. 27, 2011

(30) Foreign Application Priority Data

Apr. 27, 2010 (FR) ..... 10 01799

(51) Int. Cl.
*F42C 15/00* (2006.01)

(52) U.S. Cl.
USPC ..... 102/221; 102/200; 102/265

(58) Field of Classification Search
USPC ..... 102/221, 265, 200, 266, 202.5, 206, 102/235, 226, 702, 240
See application file for complete search history.

(56) References Cited

U.S. PATENT DOCUMENTS

| | | | | |
|---|---|---|---|---|
| 3,397,640 | A * | 8/1968 | Ziemba et al. | 102/243 |
| 3,585,935 | A * | 6/1971 | Birkigt | 102/240 |
| 3,595,169 | A * | 7/1971 | Ziemba | 102/235 |
| 3,877,378 | A * | 4/1975 | Clark et al. | 102/207 |
| 3,954,061 | A * | 5/1976 | Rudenauer et al. | 102/210 |
| 4,242,964 | A * | 1/1981 | Warren et al. | 102/275 |
| 4,286,521 | A * | 9/1981 | Marer | 102/200 |
| 4,406,225 | A * | 9/1983 | Backstein et al. | 102/235 |
| 4,440,085 | A * | 4/1984 | Rossmann et al. | 102/235 |
| 4,458,594 | A * | 7/1984 | Weber et al. | 102/240 |
| 4,510,869 | A * | 4/1985 | Nicolas et al. | 102/240 |
| 4,736,682 | A * | 4/1988 | Roosmann | 102/269 |
| 5,243,912 | A * | 9/1993 | Ziemba | 102/235 |
| 5,271,327 | A | 12/1993 | Filo et al. | |
| 5,889,267 | A * | 3/1999 | Robin et al. | 235/380 |
| 6,244,184 | B1 * | 6/2001 | Tadmor | 102/266 |
| 6,418,853 | B1 * | 7/2002 | Duguet et al. | 102/206 |
| 6,463,855 | B2 * | 10/2002 | Zehnder et al. | 102/223 |
| 7,320,285 | B1 * | 1/2008 | Munsinger et al. | 102/229 |
| 7,430,964 | B1 * | 10/2008 | Munsinger et al. | 102/229 |
| 7,600,475 | B1 | 10/2009 | Friedberg et al. | |
| 8,091,478 | B1 * | 1/2012 | Khuc et al. | 102/304 |

(Continued)

FOREIGN PATENT DOCUMENTS

| | | |
|---|---|---|
| DE | 1 229 420 | 11/1966 |
| FR | 2533686 A1 | 3/1984 |
| FR | 2689972 A1 | 10/1993 |
| GB | 1 389 360 | 4/1975 |

OTHER PUBLICATIONS

French Search Report issued in French Application No. 1001799 dated Dec. 7, 2010 (with translation).

*Primary Examiner* — Bret Hayes
*Assistant Examiner* — Joshua Freeman
(74) *Attorney, Agent, or Firm* — Oliff & Berridge, PLC

(57) ABSTRACT

A priming device for a projectile incorporating a safety and arming device as well as an electrically initiated detonator that is activated by an electronic firing module, wherein the priming device incorporates a second detonator integral with a rotor or flap of the safety and arming device, the second detonator being activated by a mobile firing pin, such firing pin being arranged opposite a first detonator so as to be projected by the gases resulting from the ignition of the latter.

13 Claims, 5 Drawing Sheets

(56) References Cited

U.S. PATENT DOCUMENTS 8,104,405 B2 * 1/2012 LaFont et al. ..... 102/252
8,297,897 B2 * 10/2012 Auriol et al. ..... 411/43
2004/0144279 A1 7/2004 Glatthaar et al.
2005/0188875 A1 * 9/2005 Matsuda et al. ..... 102/206
2008/0223243 A1 * 9/2008 Munsiger et al. ..... 102/226
2010/0258021 A1 * 10/2010 Lafont et al. ..... 102/222

* cited by examiner

PRIMING DEVICE INITIATED ELECTRICALLY FOR A PROJECTILE

BACKGROUND OF THE INVENTION

1. Field of the Invention

The technical scope of the invention is that of devices enabling a projectile to be primed.

2. Description of the Related Art

Classically, these devices (often called "fuses") incorporate a safety and arming device that ensures the de-aligning of the pyrotechnic ignition train as well as an electrically initiated detonator that is activated by an electronic firing module.

These devices are well known to those skilled in the art. Reference may be made, for example, to U.S. Pat. No. 5,271,327 that describes such a device.

The electronic firing module enables different operating modes to be managed for the device, for example: a timer mode (with the timing being programmed before firing), an impact mode, a delayed impact mode, etc.

The timer module incorporates one or several electronic cards as well as a power source. The detonator is more often integral with a fuse-holder flap carried by the safety and arming device. This is linked to the electronic module by conductors or flexible conductive strips.

Integrating this pyrotechnic component into a projectile is an operation that is difficult and that presents certain pyrotechnic risks.

Furthermore, the design of a new projectile requires the study and design of a complete fuse incorporating the safety and arming device and the electronic module. These two devices are, in fact, more often than not, closely interlinked and it is impossible to modify one without also modifying the other. Such modifications are particularly complex in the field of medium caliber projectiles (calibers of less than 75 mm) since their components are reduced in size and available space is also limited.

SUMMARY OF THE INVENTION

The aim of the invention is to propose an architecture in which integration into a projectile is simplified since the safety and arming device is separate from the electronic module and from the pyrotechnic device triggered by this module.

Thus, the invention relates to a priming device for a projectile that incorporates a safety and arming device as well as an electrically initiated detonator that is activated by an electronic firing module, priming device wherein it incorporates a second detonator integral with a rotor or flap of the safety and arming device, the second detonator being activated by a mobile firing pin, such firing pin being arranged opposite a first detonator so as to be projected by the gases resulting from the ignition of the latter.

According to a particular embodiment, the firing pin is integral with a spacer plate fixed with respect to a body of the projectile, the plate incorporating an embrittlement groove surrounding the firing pin.

The embrittlement groove may delimit a cup integral with the firing pin, such cup delimiting a cavity in which the first detonator is positioned.

According to another embodiment, the embrittlement groove may delimit a small median plate incorporating a face lying opposite the first detonator.

The device may, in this case, incorporate a washer integral with the body of the projectile, such washer against which the plate will be pressed and which will incorporate a median part against which the median plate will be pressed.

The washer may incorporate drill holes to enable a plastic coating material for the electronic firing module to be cast.

The drill holes may be made in a circular groove in the washer, such groove intended to receive part of the plastic coating material.

The first detonator and the firing pin will, advantageously, be arranged along the projectile's axis.

The first detonator may be connected to an electronic card of the firing module.

The electronic card may carry a cap at least partially surrounding the first detonator, such cap ensuring an electrical contact between the card and the first detonator.

BRIEF DESCRIPTION OF THE DRAWINGS

The invention will become more apparent from the following description of a particular embodiment, such description made with reference to the appended drawings, in which.

DETAILED DESCRIPTION OF PREFERRED EMBODIMENTS

Figure 1:
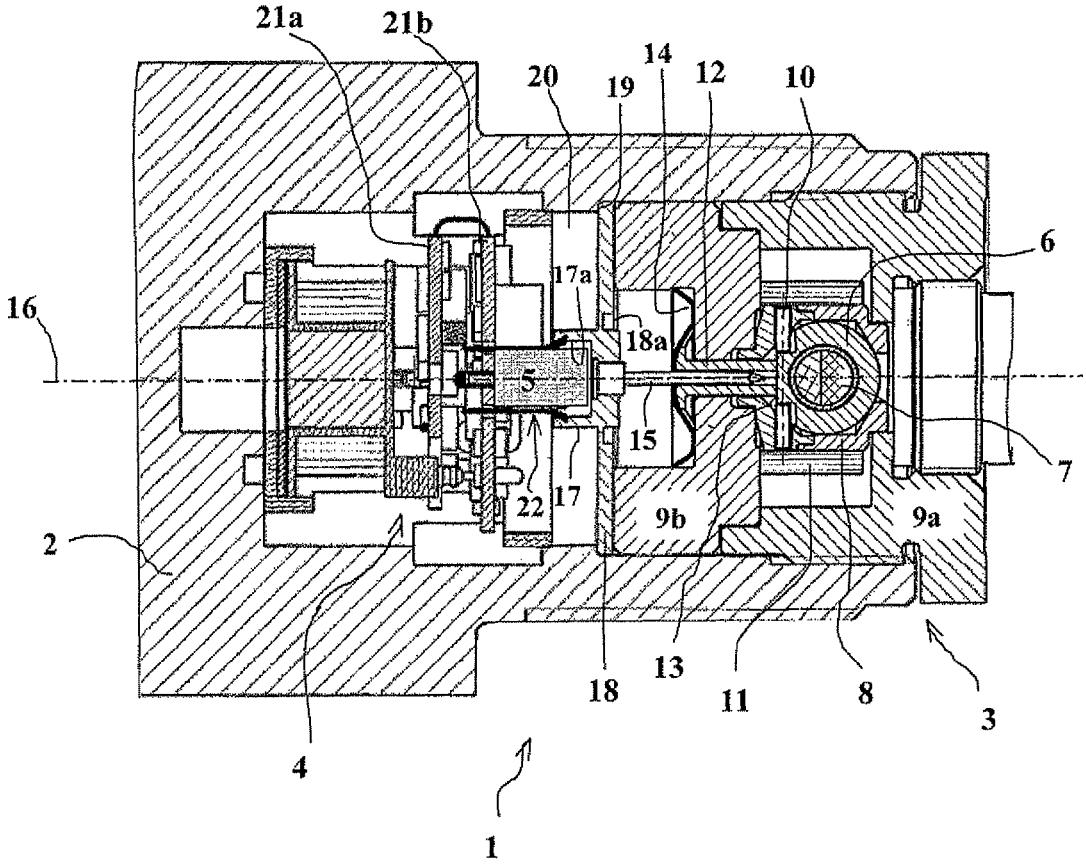
FIG. 1 is a partial section view of a projectile incorporating a priming device according to a first embodiment of the invention, such device shown in its safety position.

With reference to FIG. 1, a priming device 1 (or fuse) according to a first embodiment of the invention is incorporated into a body 2 of a projectile. The projectile is here of the spin-stabilized type, that is to say one which spins around its axis 16, such spin being imparted by the gun barrel.

This device incorporates a safety and arming device 3 as well as a first detonator 5, electrically initiated, and activated by an electronic firing module 4.

The safety and arming device 3 is a device comprising a rotor 6 having a second detonator 7 of the type initiated by percussion. This device is incorporated into a casing 9*a*, 9*b* housed in a bore hole 20 in the body 2 of the projectile.

This device is described by patent FR2689972 (as well as by patent FR2533686) to which reference may be made for further details.

As described in this patent, the rotor 6 comprises an unbalance mass and is arranged in a cage 8 mounted able to pivot with respect to the casing 9*a*, 9*b* of the safety and arming device. The pivoting is made on trunnions formed on the front and rear ends of the cage 8 and housed in matching bore holes in parts 9*a* and 9*b* of the casing.

The rotor 6 is immobilized in its safety position as shown in FIG. 1 by radial pins 10, such pins being held in place by a spiral spring 11.

The rotor 6 is also immobilized by a lock 12 in the form of a cylindrical bushing held pressed against a flattened surface 13 of the rotor by a spring washer 14.

The bushing 12 incorporates an axial drill hole which provides a passage for the tip of a firing pin 15.

This structure is identical to that described in FR2689972 and thus requires no further description here.

In accordance with the invention, the firing pin 15 is not a classical firing pin moved by a self-destruct spring or by the simple inertia of the impact on a target.

On the contrary, the firing pin 15 here is fixed with respect to the projectile body 2 (and to the priming device).

The firing pin 15 is integral with a cylindrical cup 17 which is integral with a spacer plate 18.

FIG. 1 shows that the spacer plate 18 is pinched between the bottom 9*b* of the casing of the safety and arming device 3 and a shoulder 19 of the internal bore hole 20 in the body 2. The plate 18 is thus fixed with respect to the projectile body 2.

FIG. 1 shows that the plate 18 incorporates a groove 18*a* that delimits the cup 17. This groove is circular and constitutes an embrittlement of the plate 18 surrounding the firing pin 15.

The cup 17 further delimits a cavity 17*a* intended to receive the electrical detonator 5.

FIG. 1 shows that the electronic firing module 4 here incorporates two electronic cards 21*a*, 21*b* onto which components are fixed which require no detailed explanation. One of these cards carries in particular a microprocessor which receives, via conductors (not shown), appropriate programming supplied by a programming unit integral with the weapon.

Card 21*b* arranged opposite the cup 17 carries the first detonator 5 housed within the cavity 17*a* of the cup. The first detonator 5 is connected to the card 21*b* by its axial contact by means of a deformable pin connector on the card.

FIG. 1 shows that the electronic card carries a cap 22 that partially surrounds the electric detonator 5 and constitutes a second electrical contact for the first detonator 5 (contact between the electronic card and the metallic recess in the first detonator).

Figure 2:
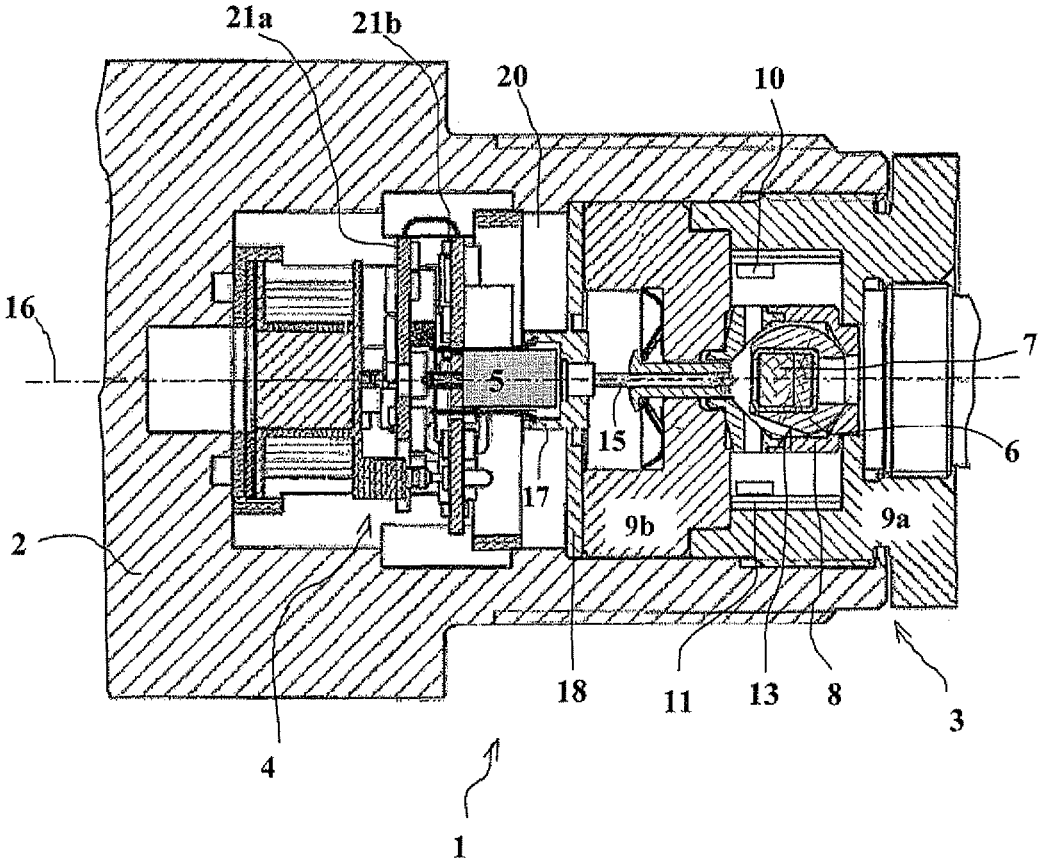
FIG. 2 shows this same device in its armed position.

The device functions as follows:

FIG. 2 shows the device after its exiting the gun barrel and after ten or so meters of its trajectory.

When the projectile is fired, the axial acceleration due to the firing leads the bushing 12 to pass through the washer 14. It therefore no longer blocks the rotor 6. The washer 14 is designed to prevent the subsequent return of the bushing towards the rotor and thus incorporates tongues (not visible in the Figures but which are described by patent FR2689972).

The rotation of the projectile further causes the spiral spring 11, which had ensured the muzzle safety for the projectile, to unwind. After the time required to unwind the spiral spring 11, the radial pins 10 have been ejected from the rotor 6 which thereafter (because of its unbalance mass) has been able to adopt its armed position with the second detonator 7 aligned along the projectile axis 16 and ready to be initiated by the firing pin 15. It is this arrangement which is shown in FIG. 2.

Figure 3:
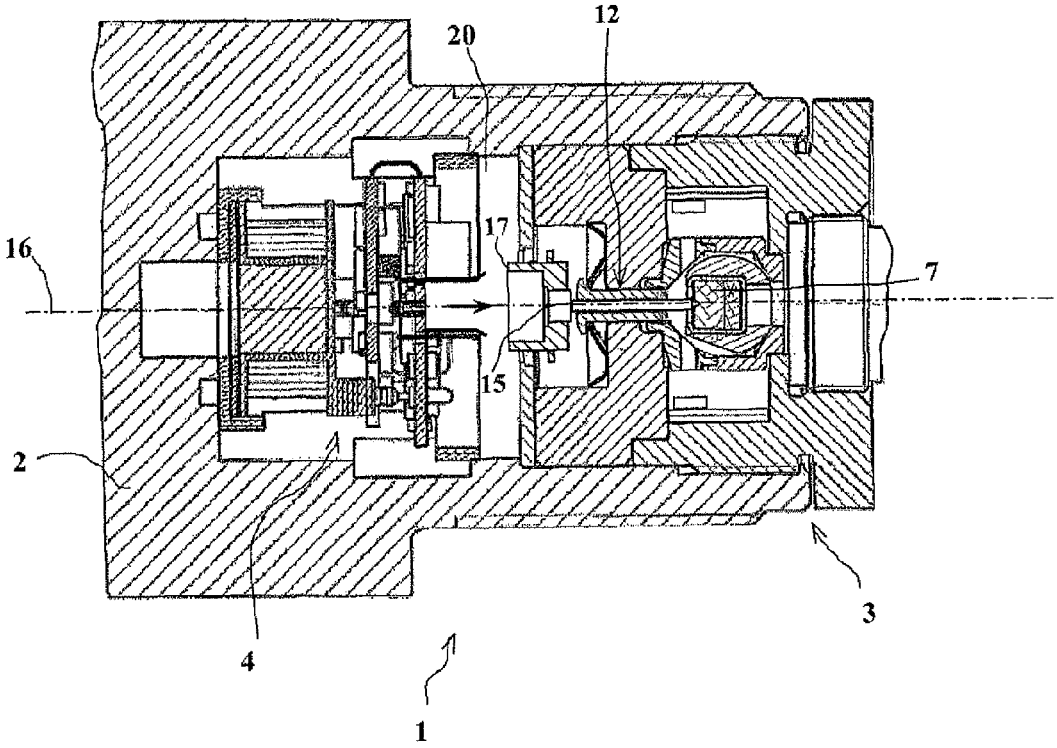
FIG. 3 shows the device after the first detonator has been initiated.

FIG. 3 shows the configuration of the device when the electronic module 4 has activated the initiation of the electric detonator 5. The gas pressure generated by the latter causes the groove 18*a* delimiting the cup 17 to shear projecting the firing pin 15 towards the second detonator 7 through the bushing and thereby initiating said bushing and projectile.

As can be seen, the invention enables the conservation of a safety and arming device that has already been defined for one projectile family and, by associating an electronic module and an electric detonator, it allows the definition of a projectile priming device giving modes of operation over a trajectory (firing after a programmed time).

An advanced priming device may thus be obtained for a reduced development cost, and it is possible for the use of a given safety and arming device to be made standard for a whole family of projectiles of different calibers and with electronics of different structures.

Here a priming device has been described whose safety and arming device implements the solutions described in patent FR2689972. It is naturally possible for a priming device to be defined according to the invention that implements a safety and arming device of a different design. This device merely needs to comprise a percussive detonator that is integral with a rotor or flap, the firing pin of said detonator being positioned opposite the electric detonator so as to be able to be projected by the gases resulting from the initiation of the latter.

Figure 4:
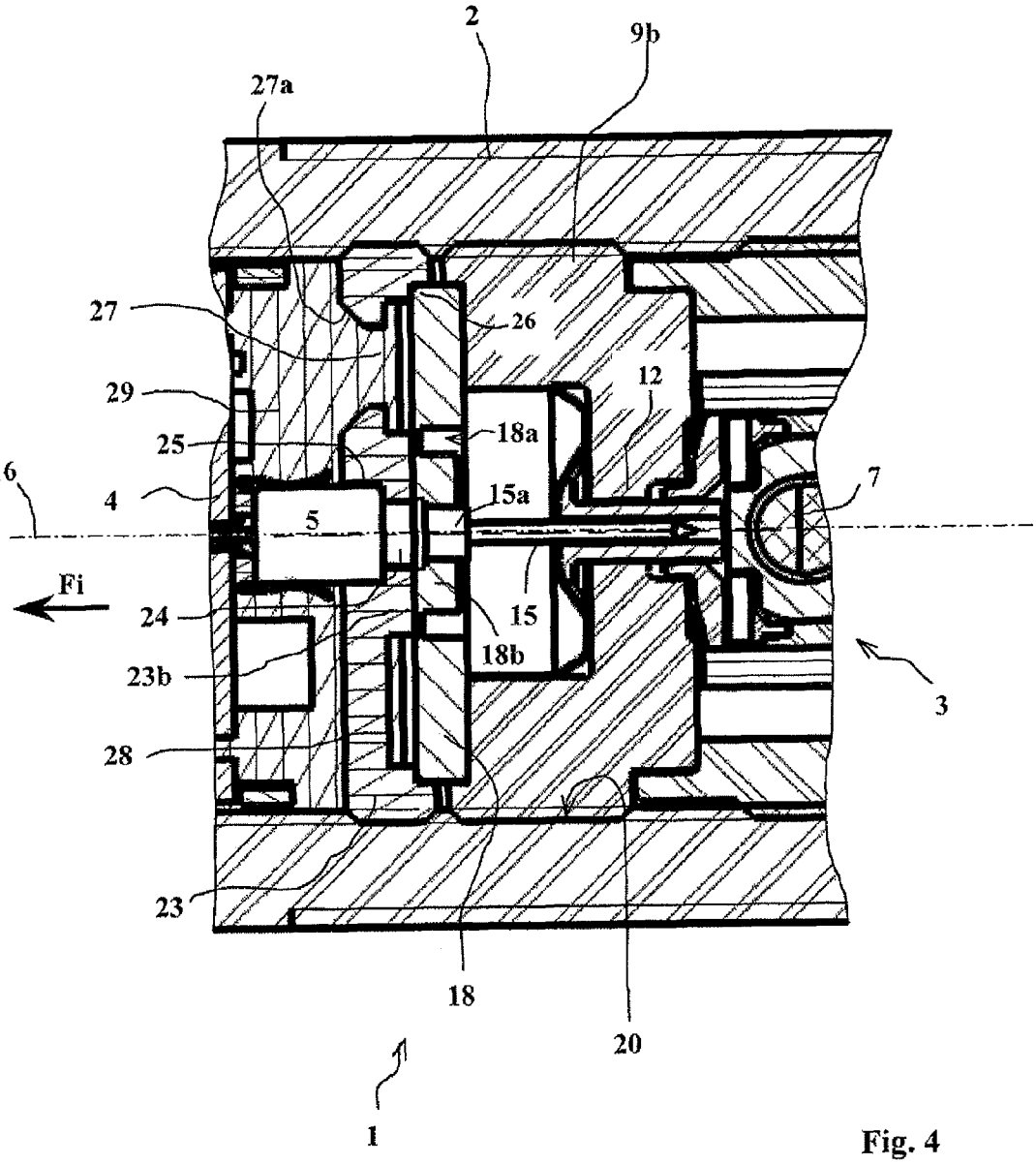
FIG. 4 is a partial section view of the priming device according to a second embodiment of the invention, such device shown in its safety position.

FIG. 4 shows a priming device 1 according to the invention in its safety position.

This embodiment differs from the previous one in the shape of the spacer plate 18.

Figure 5:
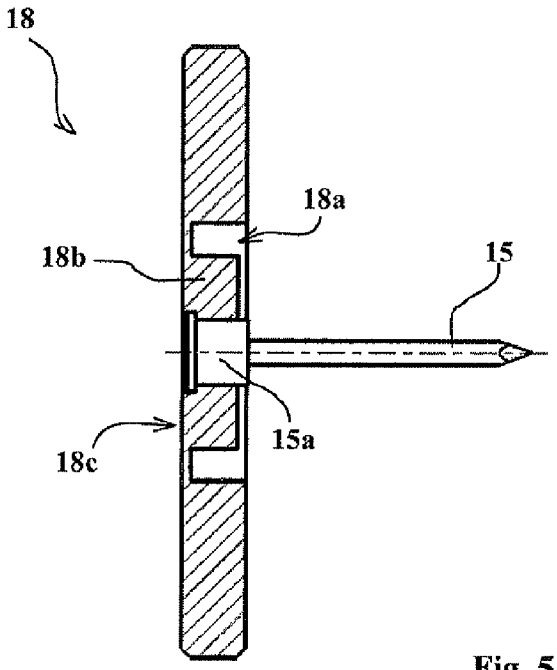
FIG. 5 is a view of the plate carrying the firing pin implemented in this second embodiment.

This plate 18 carrying the firing pin 15 is shown in greater detail in FIG. 5. Note that, contrary to the previous embodiment, the plate 18 does not incorporate a cup. The plate 18 (which is circular) still incorporates an embrittlement groove 18*a* that surrounds a base 15*a* of the firing pin 15.

The embrittlement groove 18*a* delimits a cylindrical median plate 18*b* on the plate 18 whereon the base 15*a* of the firing pin is crimped. A rear face 18*c* of the plate is arranged opposite the first detonator 5 (FIG. 4).

Note in FIG. 4 that the device also incorporates a washer 23 that is made of a plastic material. This washer is threaded and is screwed into the bore hole 20 which thus has female threading. The washer 23 incorporates an axial hole 24 connecting the first detonator 5 and the rear face 18*c* of the plate 18.

A counter-sink 25 surrounds the axial hole 24 and caps the first detonator 5. The washer 23 is shown from the front in FIG. 6. Note that it incorporates a second countersink 26 located on the face against which the plate 18 is pressed. This second countersink 26 enables the plate 18 to be centered with respect to the device (and in particular with respect to the second detonator 5).

The second countersink 26 is in the same plane as a median part 23*b* of the washer 23 against which the face 18*c* of the median plate 18*b* of the plate 18 carrying the firing pin 15 presses.

Figure 6:
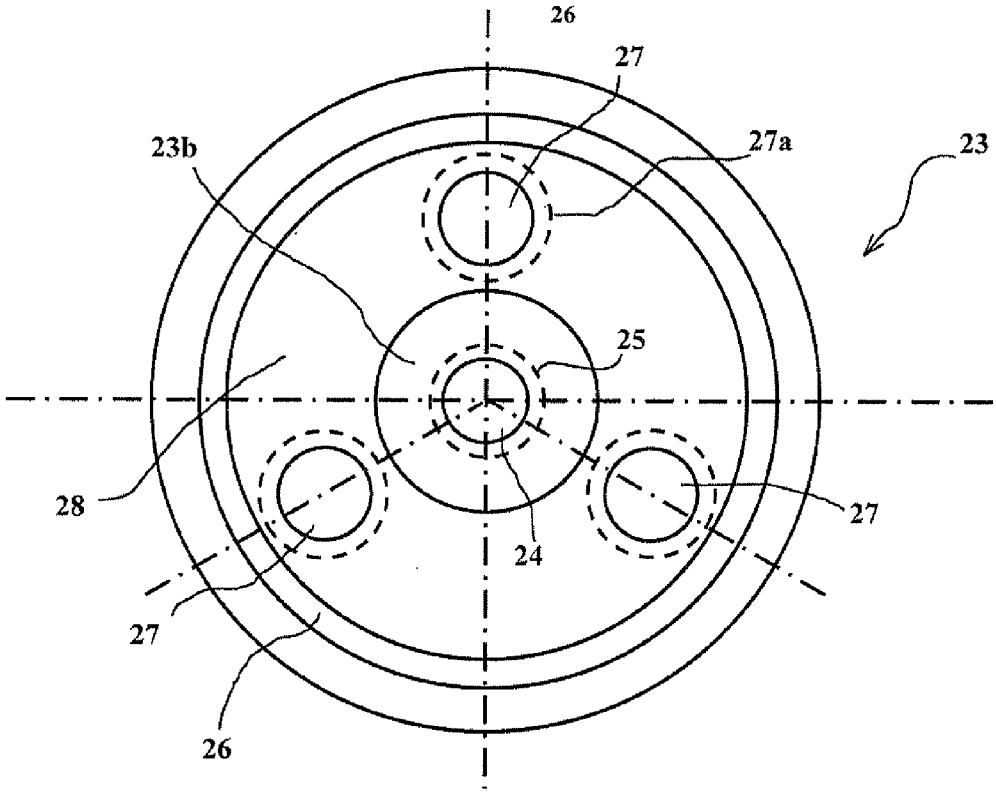
FIG. 6 is a front view of the washer on which the fuse-holder plate presses in this second embodiment.

FIG. 6 shows that the washer 23 incorporates three drill holes 27 evenly spaced angularly (thus at 120° from one another). The drill holes 27 open out into a circular groove 28 arranged between the median part 23*b* of the washer and the second countersink 26.

Furthermore, each drill hole 27 is extended by a conical flared part 27*a* on the side of the washer opposite the circular groove 28.

The drill holes 27 are intended to enable a plastic material 29 to be cast in order to coat the electronic firing module 4 onto which the first detonator 5 is fixed. Such a coating is classical in the field of ammunition safety devices. It enables the electronic components to be protected by absorbing part of the shocks to which they are subjected.

We note that, thanks to the first countersink 25, the coating 29 spares the front face of the first detonator 5.

The groove 28 receives the overflow of plastic coating material after the filling operation.

Thus, the washer 23 is partly encrusted in the coating material 29.

FIG. 4 shows that the plate 18 is pinched between the bottom 9*b* of the casing of the safety and arming device 3 and the washer 23. This bottom 9*b* is itself screwed into the threaded bore hole 20 in the body 2.

Because of the mounting of the plate 18 pinched between the washer 23 and the bottom 9*b* of the casing of the safety and arming device, the plate 18 is integral with the projectile body 2.

The washer 23 does not hinder the functioning of the first detonator 5 which is analogous to that described previously. The pressure of the gases generated by the first detonator 5 will cause the groove 18*a* delimiting the median plate 18*b* to shear and the firing pin 15 to be projected towards the second detonator 7 through the bushing 12.

The washer 23 is intended to provide an axial support for the median plate 18*b*. Such a support enables the inertial forces exerted in direction Fi during firing to be contained. Any shearing of the groove 18*a* further to firing is thus prevented without this being prevented further to the initiation of the first detonator 5. Such an arrangement improves the device's reliability and enables grooves 18*a* to be made that are relatively fragile.

What is claimed is:

1. A priming device for a projectile comprising:

a body;

a safety and arming device; and a first electrically initiated detonator that is activated by an electronic firing module, wherein the priming device incorporates a second detonator integral with a rotor or flap of the safety and arming device, the second detonator is activated by a firing pin, the firing pin is arranged in a fixed position relative to the body and arranged opposite the first detonator of the priming device, the firing pin is integral with a spacer plate fixed with respect to the body of the projectile, the spacer plate incorporating an embrittlement groove surrounding the firing pin, and the firing pin is configured to be detached from the fixed position by shearing of the spacer plate through a thickness of the spacer plate within the embrittlement groove upon ignition of the first detonator and to be projected by the gases resulting from the ignition of the first detonator.

2. The priming device according to claim 1, wherein the embrittlement groove delimits a cup integral with the firing pin, the cup delimiting a cavity in which the first detonator is positioned.

3. The priming device according to claim 2, wherein the first detonator and the firing pin are arranged along a lengthwise axis of the projectile.

4. The priming device according to claim 1, wherein the embrittlement groove delimits a small median plate incorporating a face lying opposite the first detonator.

5. The priming device according to claim 4, wherein the priming device incorporates a washer integral with the body of the projectile, the washer against which the plate is pressed and which incorporates a median part against which the face of the median plate is pressed.

6. The priming device according to claim 5, wherein the washer incorporates drill holes to enable a plastic coating material for the electronic firing module to be cast.

7. The priming device according to claim 6, wherein the drill holes are made in a circular groove in the washer, the groove intended to receive part of the plastic coating material.

8. The priming device according to claim 7, wherein the first detonator and the firing pin are arranged along a lengthwise axis of the projectile.

9. The priming device according to claim 1, wherein the first detonator and the firing pin are arranged along a lengthwise axis of the projectile.

10. The priming device according to claim 9, wherein the first detonator is connected to an electronic card of the firing module.

11. The priming device according to claim 10, wherein the electronic card carries a cap at least partially surrounding the first detonator, the cap ensuring an electrical contact between the card and the first detonator.

12. The priming device according to claim 1, wherein the firing pin maintains the fixed position before and after firing of the projectile.

13. The priming device according to claim 1, wherein the firing pin maintains the fixed position before and after arming of the projectile.

* * * * *